US011047552B2

(12) United States Patent
Jiang

(10) Patent No.: US 11,047,552 B2
(45) Date of Patent: Jun. 29, 2021

(54) LIGHT ADJUSTING DEVICE WITH EFFECT WHEEL AND STAGE LIGHT WITH THE LIGHT ADJUSTING DEVICE

(71) Applicant: Guangzhou Haoyang Electronic Co., Ltd., Guangdong (CN)

(72) Inventor: Weikai Jiang, Guangdong (CN)

(73) Assignee: Guangzhou Haoyang Electronic Co., Ltd.

( * ) Notice: Subject to any disclaimer, the term of this patent is extended or adjusted under 35 U.S.C. 154(b) by 0 days.

(21) Appl. No.: 17/040,263

(22) PCT Filed: Apr. 3, 2020

(86) PCT No.: PCT/CN2020/083231
§ 371 (c)(1),
(2) Date: Sep. 22, 2020

(87) PCT Pub. No.: WO2020/187334
PCT Pub. Date: Sep. 24, 2020

(65) Prior Publication Data

US 2021/0108784 A1 Apr. 15, 2021

(30) Foreign Application Priority Data

Mar. 15, 2019 (CN) ..... 201920331351.9

(51) Int. Cl.
*F21V 14/08* (2006.01)
*F21W 131/406* (2006.01)

(52) U.S. Cl.
CPC ..... *F21V 14/08* (2013.01); *F21W 2131/406* (2013.01)

(58) Field of Classification Search
CPC ..... F21V 14/08
See application file for complete search history.

(56) References Cited

U.S. PATENT DOCUMENTS

2006/0034089 A1 2/2006 Rasmussen et al.

FOREIGN PATENT DOCUMENTS

| | | | |
|---|---|---|---|
| CN | 102943996 | A | 2/2013 |
| CN | 203671461 | U | 6/2014 |
| CN | 203823660 | U | 9/2014 |
| CN | 206478587 | U | 9/2017 |
| CN | 209622708 | U | 11/2019 |

OTHER PUBLICATIONS

International Search Report for PCT/CN2020/083231 dated Jun. 23, 2020; 5 pages.

*Primary Examiner* — Joseph L Williams
(74) *Attorney, Agent, or Firm* — Lerner, David, Littenberg, Krumholz & Mentlik, LLP

(57) ABSTRACT

The present invention discloses a light adjusting device and a stage light with the light adjusting device. The light adjusting device includes an effect wheel provided with an effect area around a center and a moving mechanism driving the effect wheel to move among first, second, third and fourth pausing positions. When in the first pausing position, the effect area of the effect wheel is located outside the light beam. When in the second pausing position, a distance of the center of the effect wheel and a center of the light beam is less than or equal to one-half of a radius of the light beam. When in the third pausing position and when in the fourth pausing position, the center of the effect wheel is locate outside the light beam, and the effect area at least partially intercepts the light beam.

20 Claims, 7 Drawing Sheets

LIGHT ADJUSTING DEVICE WITH EFFECT WHEEL AND STAGE LIGHT WITH THE LIGHT ADJUSTING DEVICE

CROSS REFERENCE TO RELATED APPLICATIONS

The present application is a national phase entry under 35 U.S.C. § 371 of International Application No. PCT/CN2020/083231, filed Apr. 3, 2020, which claims priority from Chinese Patent Application No. 201920331351.9, filed on Mar. 15, 2019, the disclosures of which are hereby incorporated herein by reference.

TECHNICAL FIELD

The present invention relates to the technical field of stage light, and in particular to a light adjusting device and a stage light with the light adjusting device.

BACKGROUND

On stages, evening parties, theaters, dance halls and other venues, it is often necessary to use a light adjusting device to produce different lighting effects, such as flowing water, flames, cloud, or starry sky, colorful aurora, etc., to render the activity atmosphere, which is usually achieved by placing an effect wheel in front of a light source.

With the improvement of aesthetics, the light adjusting device is naturally required to produce more beautiful lighting effects. The existing light adjusting device can achieve limited lighting effects, and cannot make full use of the existing effect wheel to achieve more lighting effects, which is not conducive to the sale and use of the product.

SUMMARY

The present invention provides a light adjusting device and a stage light with the light adjusting device in order to overcome at least one of the above-mentioned defects in the prior art. The light adjusting device enables different areas of an effect wheel to intercept the light beam, and various lighting effects can be realized.

In order to overcome the above-mentioned technical problems, the technical solution that the present invention adopts is: a light adjusting device, including an effect wheel for changing a visual effect of a light beam, and a moving mechanism for driving the effect wheel to move. The effect wheel is provided with an effect area around a center. The moving mechanism drives the effect wheel to move among a first pausing position, a second pausing position, a third pausing position and a fourth pausing position. When the effect wheel is in the first pausing position, the effect area of the effect wheel is located outside the light beam. When the effect wheel is in the second pausing position, a distance of the center of the effect wheel and a center of the light beam is less than or equal to one-half of a radius of the light beam. When the effect wheel is in the third pausing position and when the effect wheel is in the fourth pausing position, the center of the effect wheel is located outside the light beam, and the effect area at least partially intercepts the light beam.

The light adjusting device drives the effect wheel to move by the moving mechanism, so that the light beam is intercepted by different positions of the effect wheel. By the effects of the different positions of the effect area on the light beam, such as one or more of shading, color toning, and light splitting, corresponding light effect is presented, so as to realize full utilization of the effect wheel, showing various light effects. When the effect wheel is in the second pausing position, the center of the effect wheel and the center of the light beam roughly coincide to form an effect similar to the rotation of a wheel. When the effect wheel is in the third pausing position and when the effect wheel is in the fourth pausing position, the effect of two parts with different effect areas on the effect wheel can be presented.

Further, the moving mechanism includes a first moving unit and a second moving unit. The second moving unit drives the effect wheel to move among the first pausing position, the third pausing position and the fourth pausing position, while the first moving unit drives the effect wheel to move between the second pausing position and the third pausing position or the fourth pausing position. By cooperation of the first moving unit and the second moving unit, movement of the effect wheel among the first pausing position, the second pausing position, the third pausing position and the fourth pausing position is realized.

Further, the first moving unit drives the effect wheel to move between the second pausing position and the third pausing position or the fourth pausing position in a translational manner. The moving distance is short, and a linear movement is adopted, which can quickly realize the position change of the effect wheel.

Further, the first moving unit includes a mounting plate having a sliding rail, a first driving gear pivotally connected to the mounting plate, and a sliding plate slidably mounted on the sliding rail. The sliding plate is fixed with a rack having a same length direction as the sliding rail. The rack is meshed with the first driving gear. The second moving unit is mounted on the sliding plate. The first driving gear rotates, and the sliding plate is pulled by the rack to slide on the sliding rail of the mounting plate.

Further, the second moving unit drives the effect wheel to move among the first pausing position, the third pausing position and the fourth pausing position in a swinging manner. The moving distance is long. Compared with the linear movement, the swinging manner can reduce the space occupied by the effect wheel moving among the first pausing position, the third pausing position and the fourth pausing position.

Further, the effect wheel is mounted on the supporting plate. The second moving unit includes a synchronous belt, a driven wheel fixed to the supporting plate, and a driving wheel driving the driven wheel to rotate by the synchronous belt.

Further, when the effect wheel is in the second pausing position, the distance of the center of the effect wheel and the center of the light beam is less than or equal to one-fifth of the radius of the light beam. When the final projected light area is not large, it is not easy for the observer to notice that the center of the effect wheel is slightly deviated from the center of the light beam, which can better show the wheel effect and make the effect on the effect wheel roughly rotate around the center of the light beam.

Further, when effect wheel is in the second pausing position, the distance between the center of the effect wheel and the center of the light beam is zero. At this time, the wheel effect can be perfectly realized, and the effect on the effect wheel can be rotated around the center of the light beam.

Further, an included angle between a direction of a radius extending from the center of the effect wheel to the center of the light beam when the effect wheel is in fourth pausing position and a direction of a radius extending from the center of the effect wheel to the center of the light beam when the effect wheel is in the third pausing position is 80° to 90°. That is, the effects of the effect areas at the two approximately vertical radiuses of the effect wheel are presented.

Further, the included angle between the direction of the radius extending from the center of the effect wheel to the center of the light beam when the effect wheel is in the fourth pausing position and the direction of the radius extending from the center of the effect wheel to the center of the light beam when the effect wheel is in the third pausing position is 90°. That is, the effects of the effect areas at the two positions where the radiuses of the effect wheel are absolutely vertical are presented.

Further, it further includes a rotation driving mechanism for driving the effect wheel to rotate. Thereby, the rotation of the effect wheel can be realized, and the effect that the light adjusting device can present can be increased.

Further, the rotation driving mechanism includes a second driving gear. The second driving gear drives a saw-toothed edge of a periphery of the effect wheel in a direct or indirect meshing manner.

Further, the effect area radiates radially outward from the center of the effect wheel. At this time, when the effect wheel is in the third pausing position and when the effect wheel is in the fourth pausing position, the effects of vertical or horizontal stripes can be achieved, respectively.

Further, the effect area on the effect wheel at least has one effect element of a continuous dynamic pattern, a fixed pattern, a rotating pattern, a prism and a color filter.

The present invention further provides a stage light including a light source and the light adjusting device of any of the foregoing. The light adjusting device is mounted on a holder. The holder is provided with a loophole. The light beam is formed by a light emitted by the light source passing through the loophole.

100: effect wheel; 110: effect area; 120: saw-toothed edge; 200: moving mechanism; 210: first moving unit; 211: mounting plate; 212: sliding rail; 213: first driving gear; 214: sliding plate; 215: rack; 220: second moving unit; 221: driven wheel; 222: synchronous belt; 223: driving wheel; 300: supporting plate; 400: second driving gear; 500: holder; 510: loophole.

DETAILED DESCRIPTION

The accompanying drawings are only for illustrative purposes and cannot be construed as limitations on this patent. In order to better illustrate the embodiment, some parts of the accompanying drawings may be omitted, enlarged or shrunk, and do not represent the size of an actual product. For those skilled in the art, it is understandable that some well-known structures and their descriptions may be omitted in the accompanying drawings. The positional relationship described in the accompanying drawings is only for illustrative purposes, and cannot be understood as a limitation of this patent.

Figure 1:
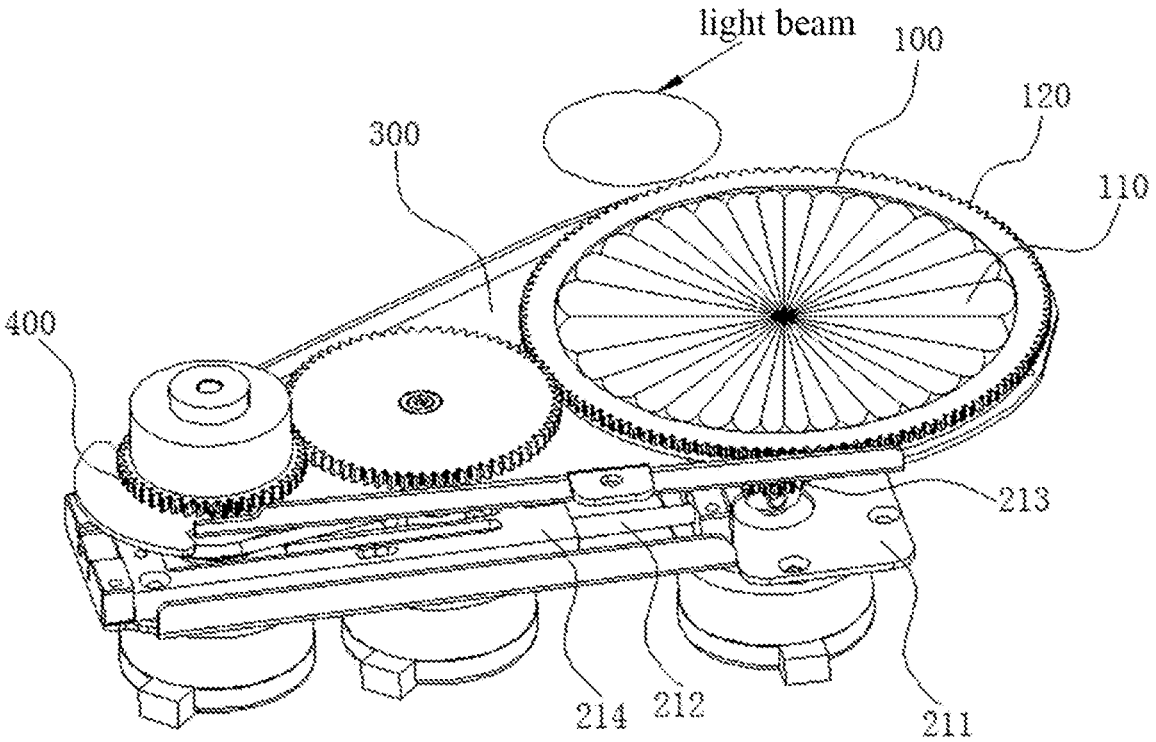
FIG. 1 is a structural diagram of the effect wheel of a light adjusting device according to the present invention in a first pausing position.
Figure 2:
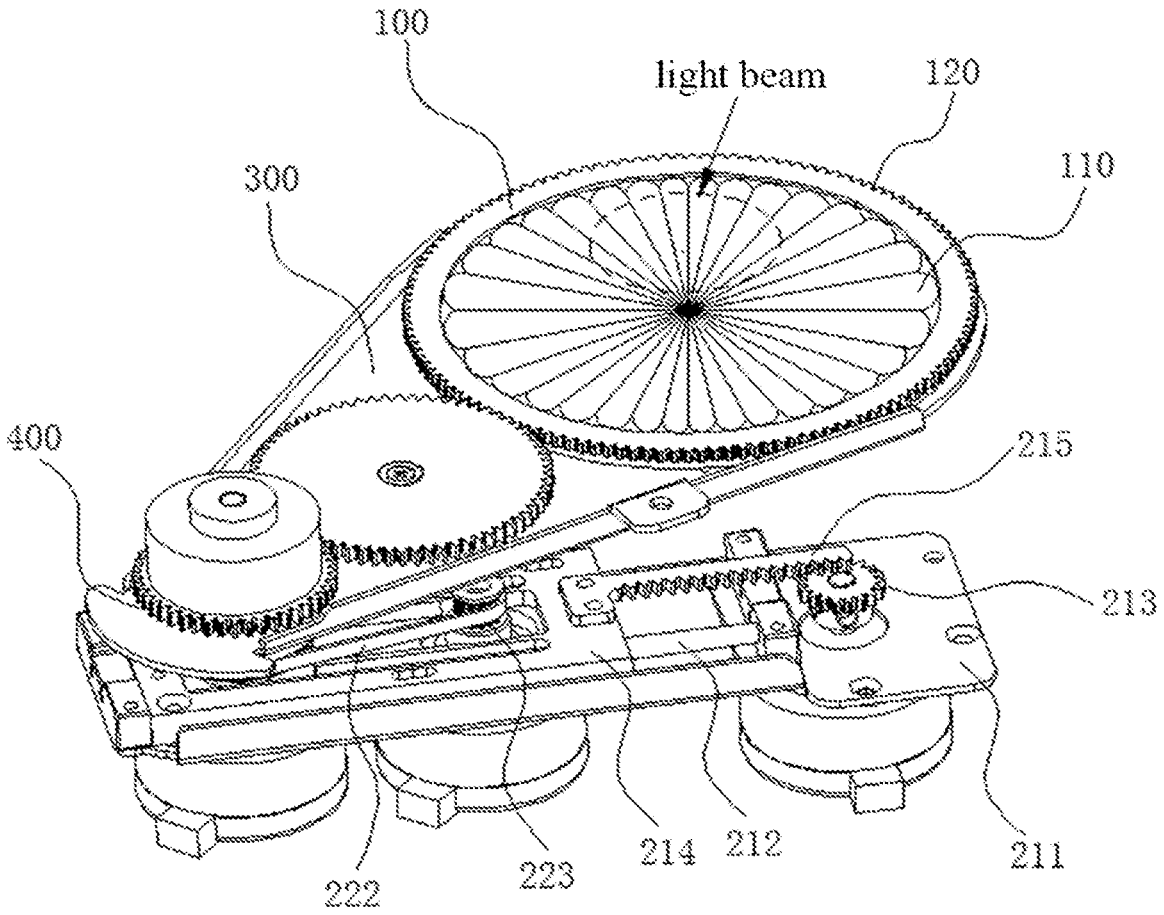
FIG. 2 is a structural diagram of the effect wheel of the light adjusting device according to the present invention in a third pausing position.
Figure 3:
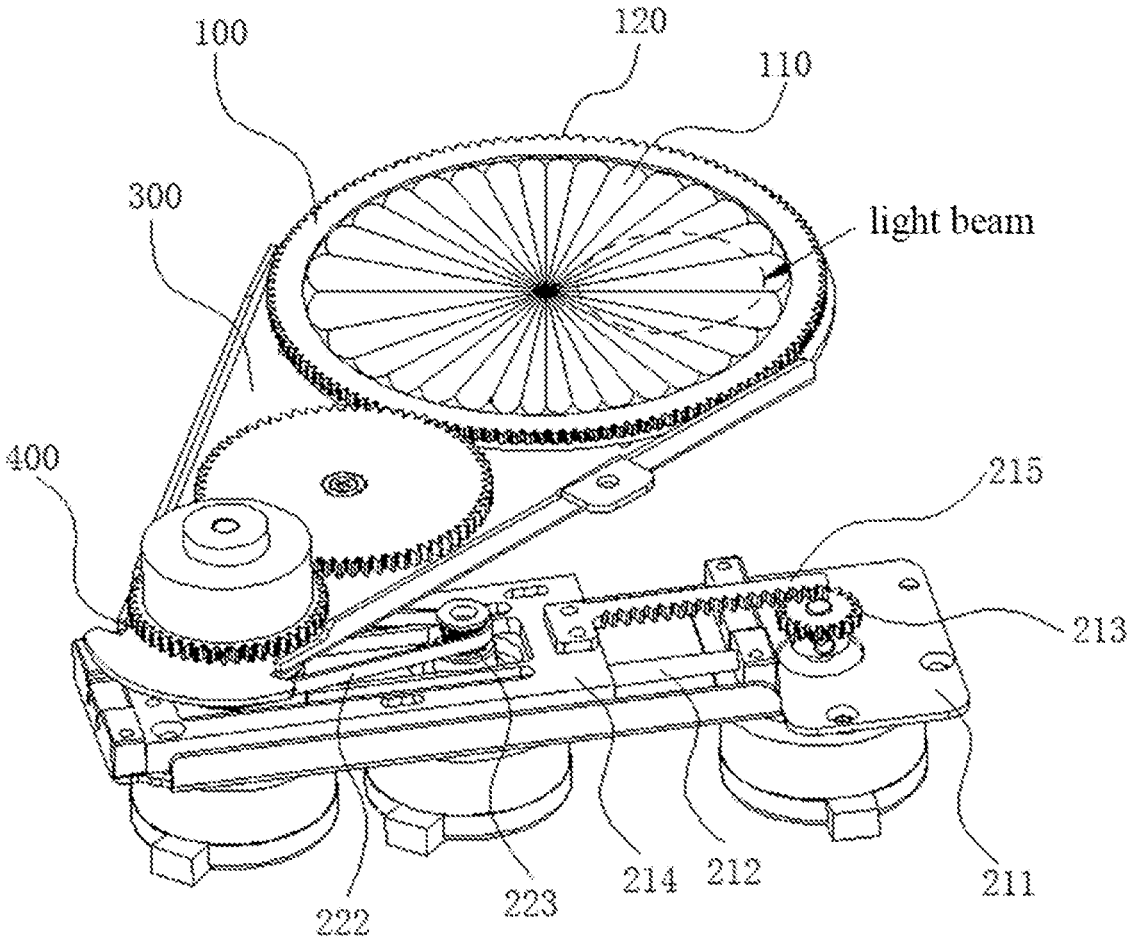
FIG. 3 is a structural diagram of the effect wheel of the light adjusting device according to the present invention in a fourth pausing position.
Figure 4:
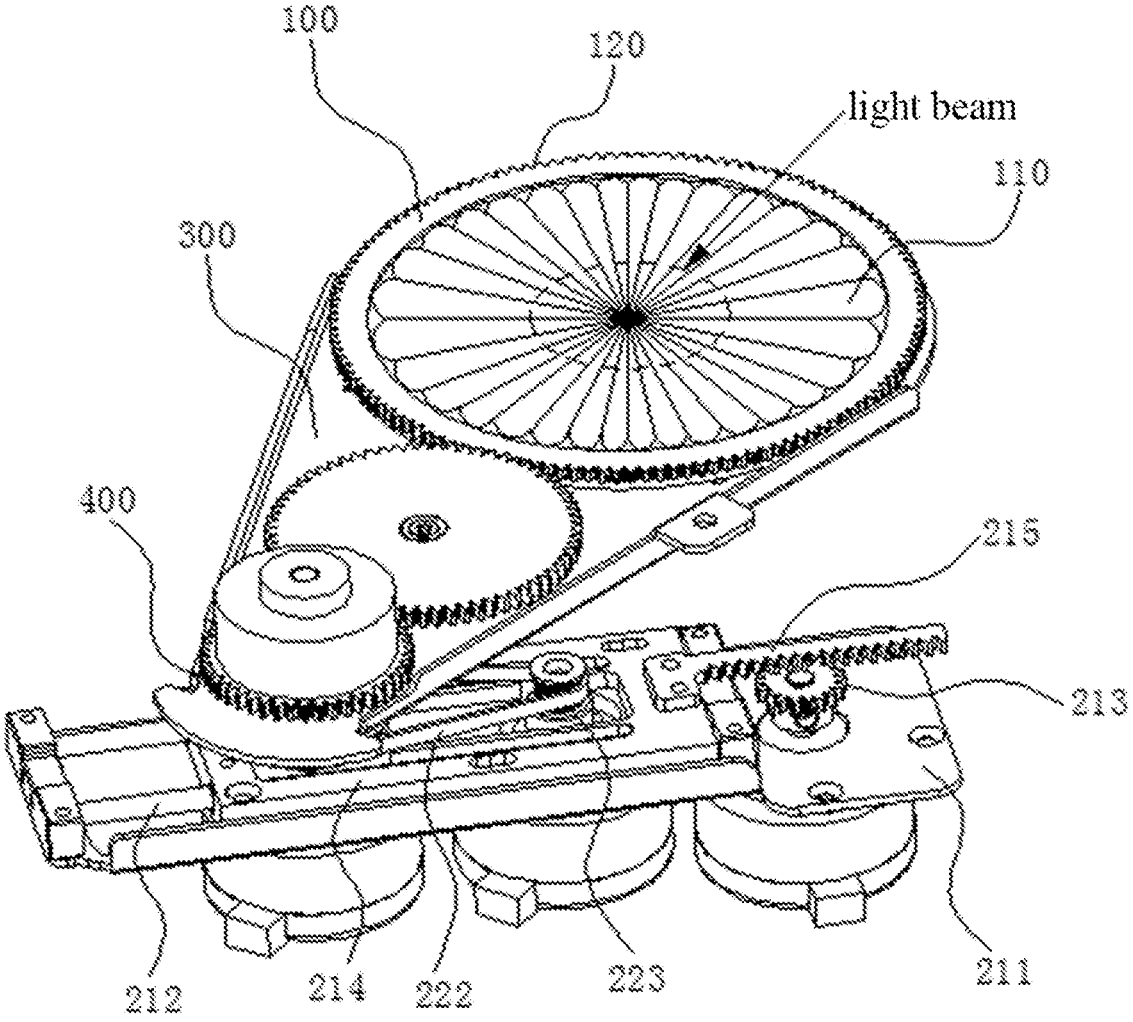
FIG. 4 is a structural diagram of the effect wheel of the light adjusting device according to the present invention in a second pausing position.

As shown in FIG. 1 to FIG. 4, the present invention provides a light adjusting device, including an effect wheel 100 for changing a visual effect of a light beam, and a moving mechanism 200 for driving the effect wheel 100 to move. The effect wheel 100 is provided with an effect area 110 around a center. The moving mechanism 200 drives the effect wheel 100 to move among a first pausing position (as shown in FIG. 1), a second pausing position (as shown in FIG. 4), a third pausing position (as shown in FIG. 2) and a fourth pausing position (as shown in FIG. 3). When the effect wheel 100 is in the first pausing position, the effect area 110 of the effect wheel 100 is located outside the light beam. When the effect wheel 100 is in the second pausing position, a distance of the center of the effect wheel 100 and a center of the light beam is less than or equal to one-half of a radius of the light beam. The radius of the light beam refers to the radius of the light beam illuminated on the effect wheel 100. Generally, the plane on which the effect wheel 100 is located is perpendicular to the illumination direction of the light beam, and the distance between the center of the effect wheel 100 and the center of the light beam refers to the vertical distance. When the effect wheel 100 is in the third pausing position and when the effect wheel 100 is in the fourth pausing position, the center of the effect wheel 100 is located outside the light beam, and the effect area 110 at least partially intercepts the light beam.

The light adjusting device drives the effect wheel 100 to move by the moving mechanism 200, so that the light beam is intercepted by different positions of the effect wheel 100. By the effects of the different positions of the effect area 110 on the light beam, such as one or more of shading, color toning, and light splitting, corresponding light effect is presented, so as to realize full utilization of the effect wheel 100, showing various light effects. When the effect wheel 100 is in the second pausing position, the distance between the center of the effect wheel 100 and the center of the light beam is relatively close to form an effect similar to the rotation of a wheel. When the effect wheel 100 is in the third pausing position and when the effect wheel 100 is in the fourth pausing position, two parts of effects of the different effect areas 110 on the effect wheel 100 can be presented.

The effect area 110 on the effect wheel 100 at least have one effect element of a continuous dynamic pattern, a fixed pattern, a rotating pattern, a prism and a color filter. That is, the effect wheel 100 of the present invention can be a fire disc or a similar disc (having continuous dynamic pattern), a prism or a similar mirror, a colored sheet or a similar sheet (both are color filter), a gobo or a similar disc (having fixed pattern or rotating pattern), etc., and also can be one of them or a mixture of more of them, as long as the visual effect of the light beam can be changed. It should be noted that the visual effect described in the present invention is not limited to observation by the naked eye, but can also be observed by instruments or equipment.

Figure 5:
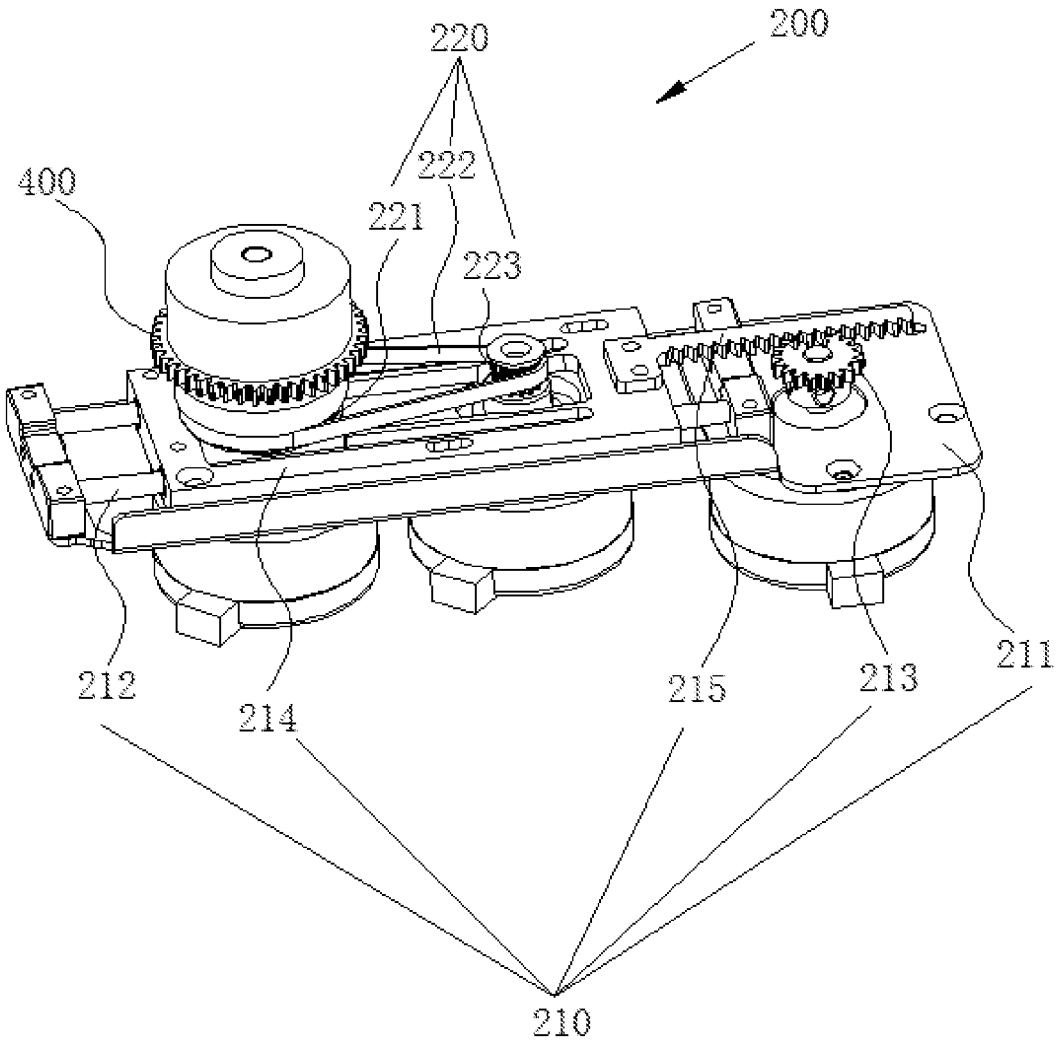
FIG. 5 is structural diagram of a moving mechanism of the light adjusting device according to the present invention.
Figure 6:
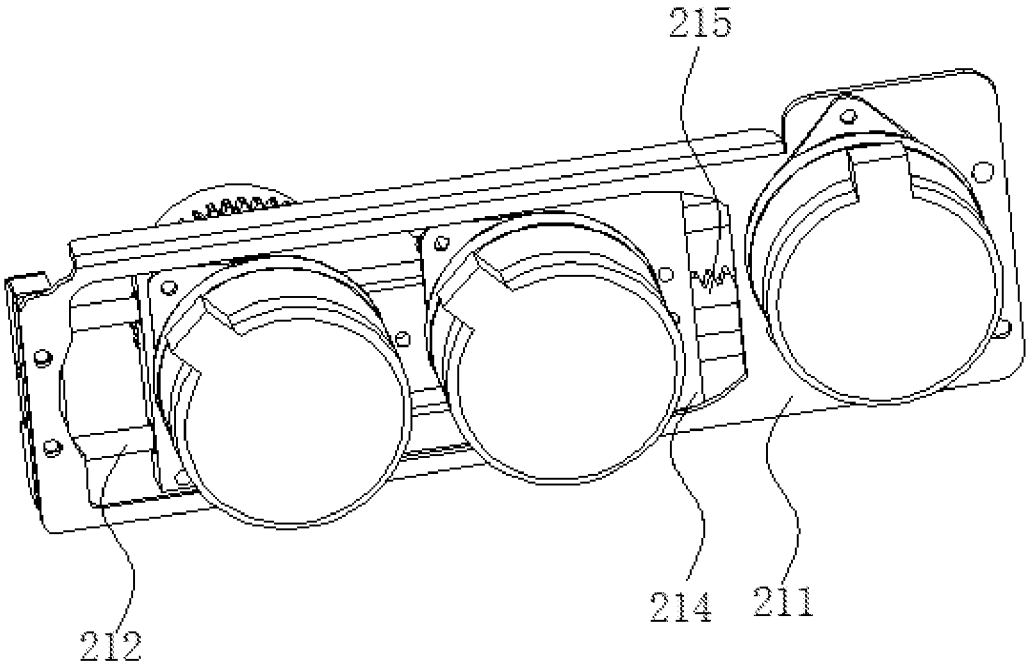
FIG. 6 is a schematic diagram of the moving mechanism of the light adjusting device according to the present invention from another perspective.

As shown in FIG. 5 and FIG. 6, in a preferred embodiment of the present invention, the moving mechanism 200 includes a first moving unit 210 and a second moving unit 220. The second moving unit 220 drives the effect wheel 100 to move among the first pausing position, the third pausing position and the fourth pausing position. The first moving unit 210 drives the effect wheel 100 to move between the second pausing position and the third pausing position or the fourth pausing position. In other embodiments, the effect wheel 100 can also be driven to move between the third pausing position and the fourth pausing position by the second moving unit 220, while the first moving unit 210 drives the effect wheel 100 to move between the second pausing position and the first pausing position, the third pausing position or the fourth pausing position. Those skilled in the art can even set more moving units to drive the movement of the effect wheel 100, as long as it can realized the movement of the effect wheel 100 among the first pausing position, the second pausing position, the third pausing position and the fourth pausing position by the moving mechanism 200.

In a preferred embodiment of the present invention, the first moving unit 210 drives the effect wheel 100 to move between the second pausing position and the third pausing position or the fourth pausing position in a translational manner. The moving distance is short, and a linear movement is adopted, which can quickly realize the position change of the effect wheel 100. In other embodiments, the first moving unit 210 drives the effect wheel 100 to move between the second pausing position and the third pausing position or the fourth pausing position in other manner, such as arc, S-curve movement, as long as the effect wheel 100 can be moved smoothly between the second pausing position and the third pausing position or the fourth pausing position.

In a preferred embodiment of the present invention, the first moving unit 210 includes a mounting plate 211 having a sliding rail 212, a first driving gear 213 pivotally connected to the mounting plate 211, and a sliding plate 214 slidably mounted on the sliding rail 212. The sliding plate 214 is fixed with a rack 215 having a same length direction as the sliding rail 212. The rack 215 is meshed with the first driving gear 213. The second moving unit 220 is mounted on the sliding plate 214. The first driving gear 213 rotates, and sliding plate 214 is pulled by the rack 215 to slide on the sliding rail 212 of the mounting plate 211, thereby realizing the movement of the effect wheel 100 between the second pausing position and the third pausing position or the fourth pausing position. In other embodiments, the first moving unit 210 can also drive the sliding plate 214 to slide by a belt, a screw, etc., as long as the effect wheel 100 can be smoothly moved between the second pausing position and the third pausing position or the fourth pausing position.

In a preferred embodiment of the present invention, the second moving unit 220 drives the effect wheel 100 to move among the first pausing position, the third pausing position and the fourth pausing position in a swinging manner. The moving distance is long. Compared with the linear movement, the swinging manner can reduce the space occupied by the effect wheel 100 moving among the first pausing position, the third pausing position and the fourth pausing position. Of course, in other embodiments, the second moving unit 220 may also drive the effect wheel 100 to move among the first pausing position, the third pausing position and the fourth pausing position in a swinging manner in other ways, such as linear, polyline, S-curve and other motion modes, as long as the effect wheel 100 can be smoothly moved among the first pausing position, the third pausing position and the fourth pausing position.

As shown in FIG. 1 to FIG. 4, in a preferred embodiment of the present invention, the effect wheel 100 is mounted on the supporting plate 300. The second moving unit 220 includes a synchronous belt 222, a driven wheel 221 fixed to the supporting plate 300, and a driving wheel 223 driving the driven wheel 221 to rotate by the synchronous belt 222. In other embodiments, the driving wheel 223 may also be directly meshed with the driven wheel 221 or driven by a transmission gear.

In a preferred embodiment of the present invention, when the effect wheel 100 is in the second pausing position, the perpendicular distance between the center of the effect wheel 100 and the center of the light beam is less than or equal to one-fifth of the radius of the light beam. When the final projected light area is not large, it is not easy for the observer to notice that the center of the effect wheel 100 is slightly deviated from the center of the light beam, which can better show the wheel effect and make the effect on the effect wheel 100 roughly rotate around the center of the light beam.

Most preferably, when the effect wheel 100 is in the second pausing position, the distance between the center of the effect wheel 100 and the center of the light beam is zero, that is, the center of the effect wheel 100 is completely coincident with the center of the light beam. At this time, the wheel effect can be perfectly realized, and the effect on the effect wheel 100 can be rotated around the center of the light beam.

In a preferred embodiment of the present invention, an included angle between a direction of a radius extending from the center of the effect wheel 100 to the center of the light beam when the effect wheel 100 is in the fourth pausing position and a direction of a radius extending from the center of the effect wheel 100 to the center of the light beam when the effect wheel 100 is in the third pausing position is 80° to 90°. That is, the effects of the effect areas 110 at the two approximately vertical radiuses of the effect wheel 100 are presented.

Most preferably, the included angle between the direction of the radius extending from the center of the effect wheel 100 to the center of the light beam when the effect wheel 100 is in the fourth pausing position and the direction of the radius extending from the center of the effect wheel 100 to the center of the light beam when the effect wheel 100 in the third pausing position is 90°. The direction of the radius extending from the center of the effect wheel 100 to the center of the light beam refers to the direction of the radius extending vertically from the center of the effect wheel 100 to the center of the light beam. That is, the effects of the effect areas 110 at the two absolutely vertical radiuses of the effect wheel 100 are presented.

In a preferred embodiment of the present invention, it further includes a rotation driving mechanism for driving the effect wheel 100 to rotate. Thereby, the rotation of the effect wheel 100 can be realized, and the effect that the light adjusting device can present can be increased.

In a preferred embodiment of the present invention, the rotation driving mechanism includes a second driving gear 400. The second driving gear 400 drives a saw-toothed edge 120 of a periphery of the effect wheel 100 in a direct or indirect meshing manner.

In the present application, the effect wheel 100 is a bearing structure, an inner ring is provided with the effect area 110, an outer ring is fixed with the supporting plate 300, and the inner ring protrudes along a direction of a center line of the bearing. The saw-toothed edge 120 is provided on a periphery of the protruding part, so as to drive the effect wheel 100 to peripherally rotate.

Furthermore, the second driving gear 400 of the rotation driving mechanism is driven by a motor, the driven wheel 221 of the second moving unit 220 is fixed to the supporting plate 300 and is pivotally connected to a shaft of the motor by a bearing, and the rotation of the driven wheel 221 and the rotation of the second driving gear 400 do not interfere with each other. Optionally, the driven wheel 221 and the second driving gear 400 are located on both sides of the supporting plate 300, respectively.

In a preferred embodiment of the present invention, the effect area 110 radiates radially outward from the center of the effect wheel 100. At this time, when the effect wheel 100 is in the third pausing position and when the effect wheel 100 is in the fourth pausing position, the effects of vertical or horizontal stripes can be achieved, respectively. Preferably, the effect wheel 100 is a fire disc, and the light-transmitting part can be hollowed out or filled with transparent material, which can achieve the effects of flame, water flow, and white clouds.

The light adjusting device described in the present invention is first rotated by the driving wheel 223 of the second moving unit 220, and the synchronous belt 222 is used to drive the driven wheel 221, so that the effect wheel 100 swings from the first pausing position to the third pausing position, and then the driving wheel 223 continues to rotate, so that the effect wheel 100 swings from the third pausing position to the fourth pausing position. Then the first driving gear 213 of the first moving unit 210 rotates, and the rack 215 drives the sliding plate 214 to slide, so that the effect wheel 100 is translated from the fourth pausing position to the second pausing position. When the effect wheel 100 moves among the first pausing position, the second pausing position, the third pausing position and the fourth pausing position, by driving the saw-toothed edge 120 of the effect wheel 100, the second driving gear 400 of the rotation driving mechanism can make the effect wheel 100 rotate synchronously.

Figure 7:
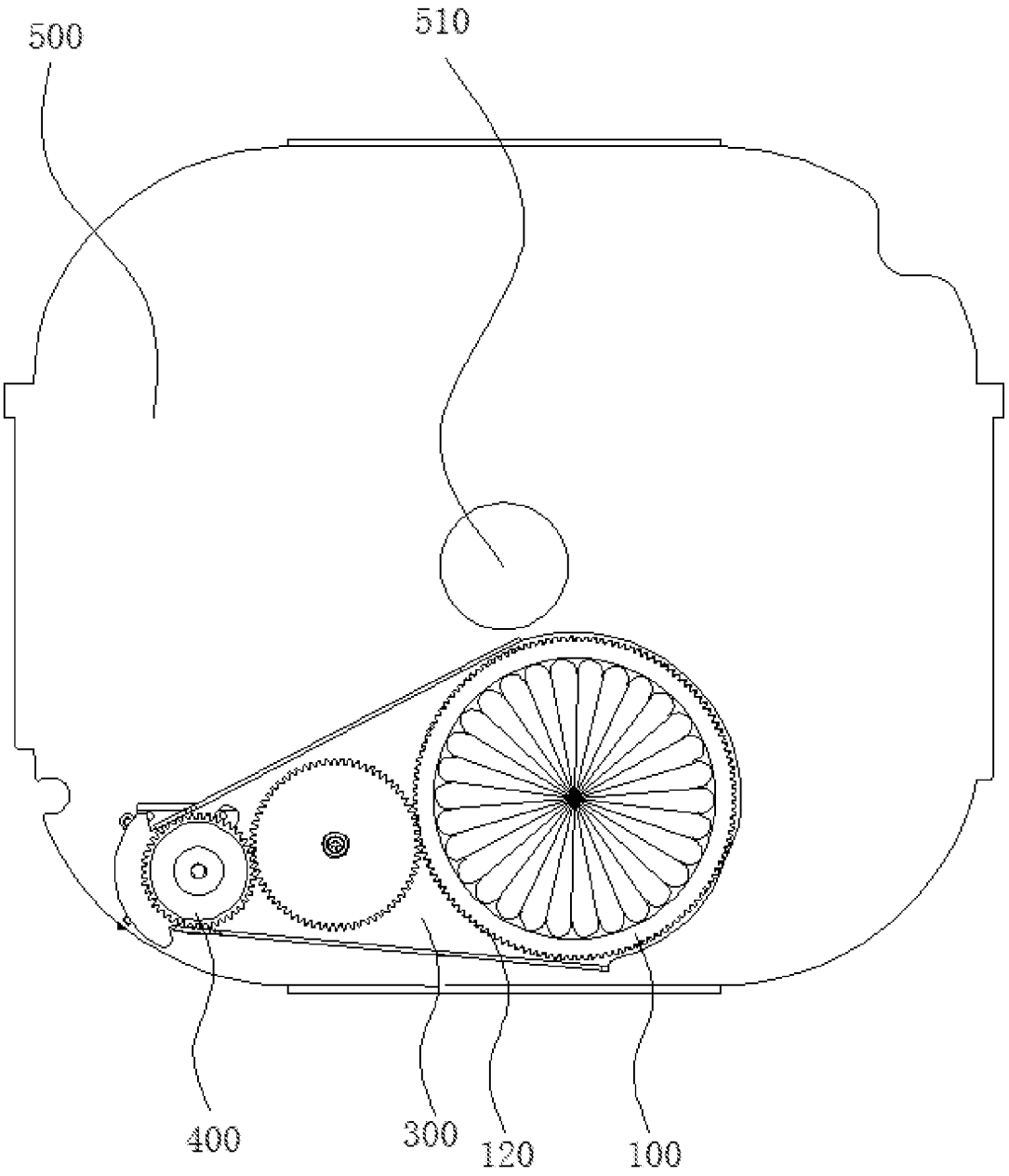
FIG. 7 is a schematic diagram of the cooperation of the light adjusting device according to the present invention and a holder.

As shown in FIG. 7, the present invention further provides a stage light including a light source and the light adjusting device of any of the foregoing. The light adjusting device is mounted on a holder 500. The holder 500 is provided with a loophole 510. The light beam is formed by a light emitted by the light source passing through the loophole 510.

In a preferred embodiment of the present invention, a radius of the loophole 510 is less than or equal to one-half of the radius of the effect wheel 100.

Obviously, the above-mentioned embodiments of the present invention are only examples to clearly illustrate the present invention, and are not intended to limit the implementation of the present invention. For those of ordinary skill in the art, other changes or variations in different forms can be made on the basis of the above description. It is not necessary and impossible to enumerate all the implementations herein. Any modification, equivalent replacement and improvement made within the spirit and principle of the present invention shall be included in the scope of protection claimed by the present invention.

What is claimed is:

1. A light adjusting device, characterized in that, the light adjusting device comprises an effect wheel for changing a visual effect of a light beam, and a moving mechanism for driving the effect wheel to move; the effect wheel is provided with an effect area around a center, and the moving mechanism drives the effect wheel to move among a first pausing position, a second pausing position, a third pausing position and a fourth pausing position;

when the effect wheel is in the first pausing position, the effect area of the effect wheel is located outside the light beam;

when the effect wheel is in the second pausing position, a distance between the center of the effect wheel and a center of the light beam is less than or equal to one-half of a radius of the light beam; and when the effect wheel is in the third pausing position and when the effect wheel is in the fourth pausing position, the center of the effect wheel is located outside the light beam, and the effect area at least partially intercepts the light beam.

2. The light adjusting device according to claim 1, characterized in that, the moving mechanism comprises a first moving unit and a second moving unit, the second moving unit drives the effect wheel to move among the first pausing position, the third pausing position and the fourth pausing position, and the first moving unit drives the effect wheel to move between the second pausing position and the third pausing position or the fourth pausing position.

3. The light adjusting device according to claim 2, characterized in that, the first moving unit drives the effect wheel to move between the second pausing position and the third pausing position or the fourth pausing position in a translational manner.

4. The light adjusting device according to claim 3, characterized in that, the first moving unit comprises a mounting plate having a sliding rail, a first driving gear pivotally connected to the mounting plate, and a sliding plate slidably mounted on the sliding rail, the sliding plate is fixed with a rack having a same length direction as the sliding rail, the rack is meshed with the first driving gear, and the second moving unit is mounted on the sliding plate.

5. The light adjusting device according to claim 2, characterized in that, the second moving unit drives the effect wheel to move among the first pausing position, the third pausing position and the fourth pausing position in a swinging manner.

6. The light adjusting device according to claim 5, characterized in that, the effect wheel is mounted on a supporting plate, the second moving unit comprises a synchronous belt, a driven wheel fixed to the supporting plate, and a driving wheel driving the driven wheel to rotate by the synchronous belt.

7. The light adjusting device according to claim 1, characterized in that, when the effect wheel is in the second pausing position, the distance between the center of the effect wheel and the center of the light beam is less than or equal to one-fifth of the radius of the light beam.

8. The light adjusting device according to claim 7, characterized in that, when the effect wheel is in the second pausing position, the distance between the center of the effect wheel and the center of the light beam is zero.

9. The light adjusting device according to claim 1, characterized in that, an included angle between a direction of a radius extending from the center of the effect wheel to the center of the light beam when the effect wheel is in the fourth pausing position and a direction of a radius extending from the center of the effect wheel to the center of the light beam when the effect wheel is in the third pausing position is 80° to 90°.

10. The light adjusting device according to claim 9, characterized in that, the included angle between the direction of the radius extending from the center of the effect wheel to the center of the light beam when the effect wheel is in the fourth pausing position and the direction of the radius extending from the center of the effect wheel to the center of the light beam when the effect wheel is in the third pausing position is 90°.

11. The light adjusting device according to claim 1, characterized in that, the light adjusting device further comprises a rotation driving mechanism for driving the effect wheel to rotate.

12. The light adjusting device according to claim 11, characterized in that, the rotation driving mechanism comprises a second driving gear and the second driving gear drives a saw-toothed edge of a periphery of the effect wheel in a direct or indirect meshing manner.

13. The light adjusting device according to claim 1, characterized in that, the effect area radiates radially outward from the center of the effect wheel.

14. The light adjusting device according to claim 1, characterized in that, the effect area on the effect wheel at least has one effect element of a continuous dynamic pattern, a fixed pattern, a rotating pattern, a prism, and a color filter.

15. A stage light, characterized in that, the stage light comprises a light source and a light adjusting device according to claim 1, the light adjusting device is mounted on a holder, the holder is provided with a loophole, and the light beam is formed by a light emitted by the light source passing through the loophole.

16. A stage light, characterized in that, the stage light comprises a light source and a light adjusting device according to claim 2, the light adjusting device is mounted on a holder, the holder is provided with a loophole, and the light beam is formed by a light emitted by the light source passing through the loophole.

17. A stage light, characterized in that, the stage light comprises a light source and a light adjusting device according to claim 7, the light adjusting device is mounted on a holder, the holder is provided with a loophole, and the light beam is formed by a light emitted by the light source passing through the loophole.

18. A stage light, characterized in that, the stage light comprises a light source and a light adjusting device according to claim 9, the light adjusting device is mounted on a holder, the holder is provided with a loophole, and the light beam is formed by a light emitted by the light source passing through the loophole.

19. A stage light, characterized in that, the stage light comprises a light source and a light adjusting device according to claim 11, the light adjusting device is mounted on a holder, the holder is provided with a loophole, and the light beam is formed by a light emitted by the light source passing through the loophole.

20. A stage light, characterized in that, the stage light comprises a light source and a light adjusting device according to claim 14, the light adjusting device is mounted on a holder, the holder is provided with a loophole, and the light beam is formed by a light emitted by the light source passing through the loophole.

* * * * *